US006419223B1

(12) United States Patent
Sting et al.

(10) Patent No.: US 6,419,223 B1
(45) Date of Patent: Jul. 16, 2002

(54) DEVICE FOR HANDLING SHEET-LIKE PIECES

(75) Inventors: Martin Sting, Frankfurt; Christian Botschek, Rodermark, both of (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/486,546

(22) PCT Filed: Sep. 8, 1998

(86) PCT No.: PCT/EP98/05727

§ 371 (c)(1),
(2), (4) Date: May 24, 2000

(87) PCT Pub. No.: WO99/12836

PCT Pub. Date: Mar. 18, 1999

(30) Foreign Application Priority Data

Sep. 10, 1997 (DE) ..... 197 39 784

(51) Int. Cl.[7] ..... B65H 5/12

(52) U.S. Cl. ..... 271/268; 271/85; 294/104; 294/116

(58) Field of Search ..... 271/268, 85; 294/104, 294/116

(56) References Cited

U.S. PATENT DOCUMENTS 4,462,585 A * 7/1984 Gieson et al. ..... 271/268 X
4,511,130 A * 4/1985 Barton et al. ..... 271/268

* cited by examiner

*Primary Examiner*—David H. Bollinger
(74) *Attorney, Agent, or Firm*—Michael J. Cummings

(57) ABSTRACT

With regard to an installation designed to handle sheet-like pieces by means of gripper arms (1) provided with gripper clutches (9, 10), a particularly simple and economical structure requiring less components can be obtained by a design according to which the distribution crankshaft gear carries a distributing disk with operating cams **(18, 11*a*, 18*a*, 113) for enabling oscillatory movements by the gripper arm (1), said disk interacting with the cam follower (17) in an actuating mechanism which is coupled with the swivelling gripper clutch (10) of the clamping device (3) and mounted on the gripper arm (1)**. The distributing disk has been specially designed for that purpose.

12 Claims, 7 Drawing Sheets

2
1
8
6
7
18
5
20
14
17
15
16
19
13
9
10
12

DEVICE FOR HANDLING SHEET-LIKE PIECES

TECHNICAL FIELD

The invention relates to an apparatus for handling sheet-like conveyable articles, it also being possible for such conveyable articles to comprise folded sheets or stapled articles or the like, which are to be transported, for example, from a magazine to a conveying chain and are set down on the conveying chain.

BACKGROUND ART

Known gripper arms can be pivoted about a pivot axis, which is located at a sufficient distance above the plane of the transporting chain and/or of the plane of the sheet-like articles which are to be conveyed, from a receiving position into a discharging position. Located at the bottom end of the gripper arms in each case are gripper tongs with mutually opposite gripper claws which are prestressed into the closed position by spring means and of which generally one is connected pivotably to the gripper arm and is opened and closed by an actuating linkage both in the receiving position and in the discharging position, in order, in the receiving position, to grip a leading border of a conveyable article and, in the discharging position, to release the conveyable article again.

An actuating linkage between a framework-mounted cam plate, a cam follower, which is in contact with the latter, and the pivotable gripper claw serves for opening the gripper tongs in time with the pivoting movements of the gripper arm at least in the receiving position of the same. In the case of the known gripper-arm designs, said actuating mechanism involves comparatively high outlay and requires, for the cam-plate drive, a framework-mounted drive shaft guided parallel to the pivot axis of the gripper arm.

DISCLOSURE OF THE INVENTION

FR-A-705 283 discloses an apparatus for handling sheet-like conveyable articles which contains a pivotably mounted gripper arm which can be pivoted back and forth by means of a crank drive. Gripper tongs with a pair of gripper claws are located at the free, bottom end of the gripper arm. One of the gripper claws can be opened and closed by means of an actuating linkage likewise arranged on the gripper arm. Moreover, the gripper tongs can be pivoted in their entirety, by means of a further actuating linkage, relative to the gripper arm in order to produce a certain movement path of the gripper claws during pivoting of the gripper arm. This pivoting of the gripper tongs in their entirety is achieved in that a cam plate, which is seated on the crankshaft for the drive of the gripper arm, subjects the further actuating linkage, which is assigned to the gripper tongs and contains a cam follower, to an adjustment movement. The actuating linkage serving for pivoting the gripper tongs in their entirety acts on the gripper tongs not directly, but, on the one hand, via a directing guide, which is framework-mounted in a pivotable manner, and, on the other hand, via a follower-roller lever connected to the gripper tongs.

FR-A-2 254 435 discloses a further apparatus for handling sheet-like conveyable articles by way of a pivotably mounted gripper arm which is made to pivot by means of a connecting rod. Gripper tongs, located at the free end of the gripper arm, contain a pair of gripper claws, of which one, for opening and closing the gripper tongs, is mounted pivotably at the free gripper-arm end and is provided with a follower-roller lever which interacts with a directing guide, which is framework-mounted in a pivotable manner. Certain movements of the directing guide are produced, via a cam-plate follower of the directing guide, by means of a cam plate which circulates synchronously with a rotary drive for actuating the connecting rod acting on the gripper arm.

The invention is intended to achieve the object of configuring an apparatus for handling sheet-like conveyable articles having the features of the preamble of conveyable articles having the features of the preamble of Patent claim 1 such that the actuating mechanism for opening and closing the gripper tongs is rendered considerably simpler and less expensive, in particular a smaller number of components, in relation to known designs, being used without high precision of the gripper operation having to be dispensed with.

This object is achieved by the characterizing features of Patent claim 1. Advantageous configurations and developments form the subject matter of the patent claims subordinate to claim 1.

The idea on which the invention is based consists in the drive mechanism for producing the pivoting movements or the gripper arm itself, or of the gripper arms themselves, also being used for actuating the respective gripper claw, for which purpose the cam for the cam follower of the actuating linkage of the pivotable gripper claw is joined directly to the drive crank for the gripper-arm-pivoting connecting rod or to said connecting rod. This is because it has been found that, precisely at the point when the gripper arm reaches, as it were, the respective dead-centre positions, both the drive crank and the connecting rod of the pivot-arm drive execute comparatively rapid rotary movements or pivoting movements which are suitable for deriving the opening movement of the gripper tongs in the receiving position and the discharging position.

According to one embodiment, the actuating linkage for opening and closing the pivotable gripper claw contains a lever which is mounted on the gripper arm and to which one end of a coupling rod is connected, of which the other end is connected to the pivotable gripper claw, and on which , furthermore, the cam follower is located, the latter expediently being designed as a roller which is in contact with the cam.

It should be mentioned in this context that the cam follower or the follower roller do not, of course, have to be in contact with the directing curve of the cam throughout the entire movement sequence of said cam. Rather, the pivotable gripper claw is kept in the closed position by spring prestressing and is only moved into the open position by virtue of the cam follower running onto regions of the cam in the receiving position and/or the discharging position of the pivot arm.

BRIEF DESCRIPTION OF THE DRAWINGS

Advantageous embodiments are described herein-below with reference to the drawing, in which.

DETAILED DESCRIPTION OF THE INVENTION

Figure 1:
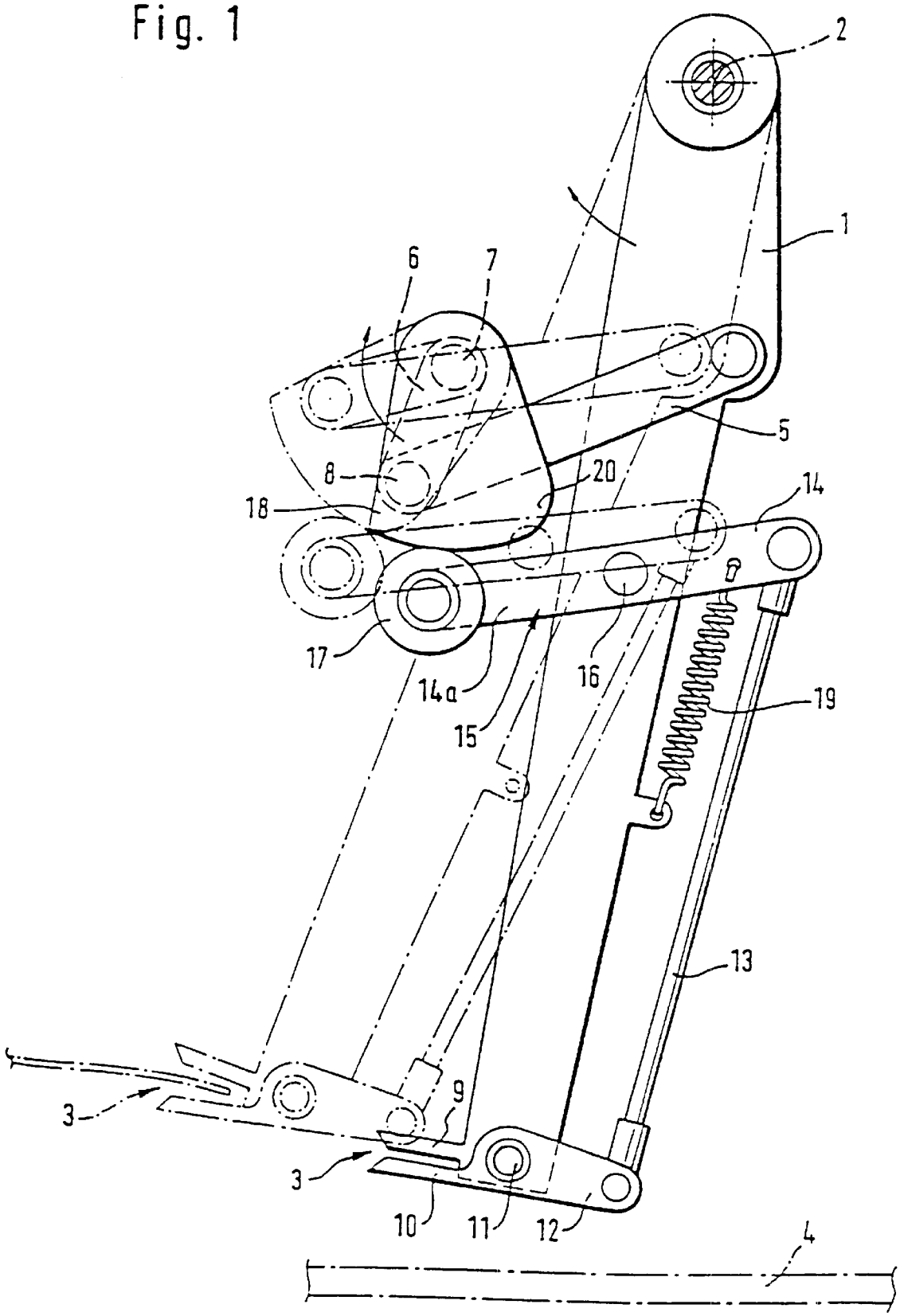
FIG. 1 illustrates a schematic side view of a first embodiment of an apparatus of the type indicated here, chain-dotted lines indicating the operating position during passage into the receiving position.

FIG. 1 shows a gripper arm 1 which can be pivoted beyond the region of a conveying chain, indicated schematically at 4, about a pivot axis 2, in the clockwise direction, into a receiving position of its gripper tongs 3, which are provided at the bottom end, and, in the anticlockwise direction, into a discharging position of said gripper tongs. Conveying on the conveying chain 4 takes place in a cyclic manner perpendicularly to the plane of the drawing, in relation to the illustration of FIG. 1.

Articulated on the gripper arm 1 is a connecting rod 5 which is actuated by a drive crank 6 which is made to rotate by a drive by way of a shaft 7. The crank radius from the shaft 7 to the point of articulation 8 of the connecting rod 5 is selected such that the gripper tongs 3 execute an operating stroke and return stroke of sufficient arc length. Means which, to simplify matters, are not illustrated in FIG. 1 may be provided in order to adjust the crank radius, for example a slot which is provided in the part 6 and is intended for the adjustment of the point of articulation 8 of the connecting rod 5.

The gripper tongs 3 contain a top gripper claw 9, which is fixed to the gripper arm 1, and a gripper claw 10, which is connected pivotably to the bottom end of the gripper arm 1 and has a projection 12 which is extended rearwards beyond the gripper-claw articulation 11 and to which a coupling rod 13 is connected in an articulated manner as illustrated. The top end of the coupling rod 13 is connected in an articulated manner to one end 14 of a double-armed lever 15 which, for its part, is connected pivotably to the gripper arm 1 at 16.

The lever arm 14*a*,which is oriented in the direction of the receiving position of the gripper arm, bears, at its free end, a follower roller 17 which interacts with a cam or a cam plate 18, which is connected integrally to the drive crank 6 or is fixed thereto. If the drive crank 6 and the cam plate 18 form two separate components, then it is possible to provide means for adjusting the cam plate 18 relative to the drive crank 6, although, to simplify the illustration, said adjustment means are not shown in FIG. 1 since they are very familiar to the person skilled in the art.

In order to determine the profile of the cam plate 18, which in the embodiment shown is approximately in the form of a sector of a circle, the locus curve of the follower roller 17 on a surface which rotates about the shaft 7 at the drive speed of the drive crank 6 is determined, with gripper claws of the gripper tongs 3 always being located in a closed position, said closed position being maintained by spring means 19 which are stressed between a spring bearing on the gripper arm 1 and the lever arm 14. In the region of the locus curve, opening cams are then joined to the profile of the cam plate 18 in those regions of the curve in which the gripper arm is located in the receiving position. In the case of the embodiment according to FIG. 1, said opening cam for opening the gripper tongs in the receiving position is approximately in the form indicated at 20. It should be noted that, in the case of the embodiment according to FIGS. 1 and 1A, the cam plate 18 is only designed for opening the gripper tongs 3 in the receiving position. For opening the gripper tongs 3 in the discharging position, in contrast, it would be necessary for the cam plate 18 to have an opening cam on the circumferential region located approximately diametrically opposite the opening cam 20, although said further opening cam has to be spaced apart from the crankshaft 7 by a radial distance which differs from that of the opening cam 20 since the gripper arm 1 has then moved in the anticlockwise direction and the follower roller 17 has passed to a different radial distance from the crankshaft 7.

Figure 1A:
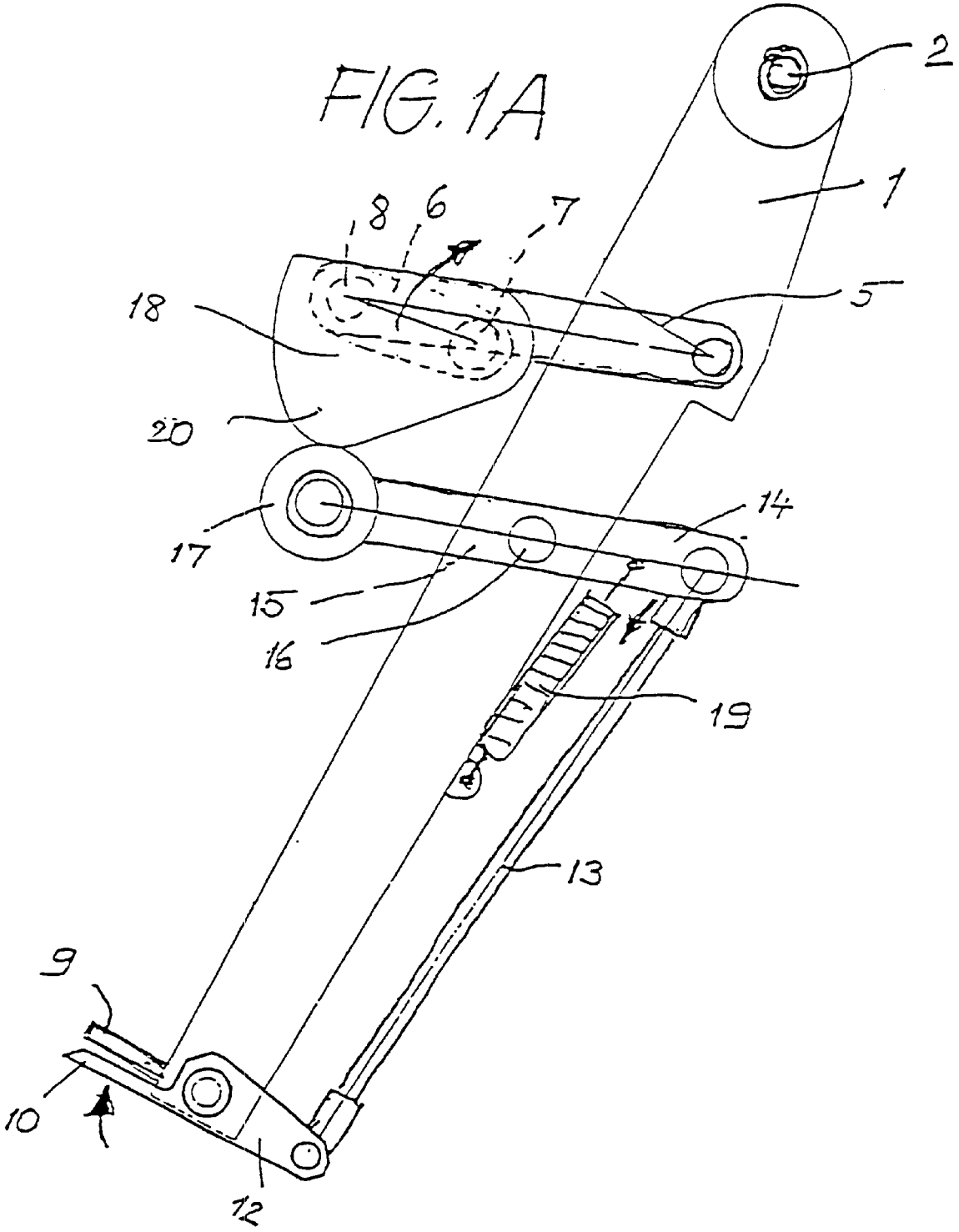
FIG. 1A illustrates a side view, corresponding to FIG. 1, of the apparatus in the phase of closure of the gripper tongs in the receiving position.

While it is therefore quite possible, in the case of the embodiment according to FIGS. 1 and 1A, to modify the cam or the cam plate 18 such that they cause the gripper tongs 3 to open both in the receiving position and in the discharging position of the gripper arm, it is preferred, in practice, to have the embodiment according to FIGS. 1 and 1A with the cam plate 18 designed, for example, in the manner shown, such that it is only in the receiving position of the gripper arm that the cam plate 18 causes the gripper tongs 3 to open, whereas the opening of the gripper tongs 3 for discharging the handled conveyable articles is brought about by a separate cam or stop which is unit-mounted in an adjustable manner and against which parts of the actuating mechanism of the gripper tongs run as the gripper arm passes into the discharging position. It should be noted here that the opening and closing characteristics of the gripper tongs 3 in the receiving position require high precision, that is to say such that the gripper tongs 3 are opened when the tips of the gripper claws 9 and 10 reach the leading edge of the conveyable articles which are to be handled, and also have to remain open until the leading edge of a conveyable article which is to be handled has moved to the full extent into the gripper tongs by virtue of forward pivoting of the gripper arm 1. Then, essentially without a simultaneous pivoting movement of the gripper arm 1, the gripper tongs 3 close rapidly on account of the opening cam 20 moving away from the follower roller 17 in a correspondingly rapid manner.

Figure 2:
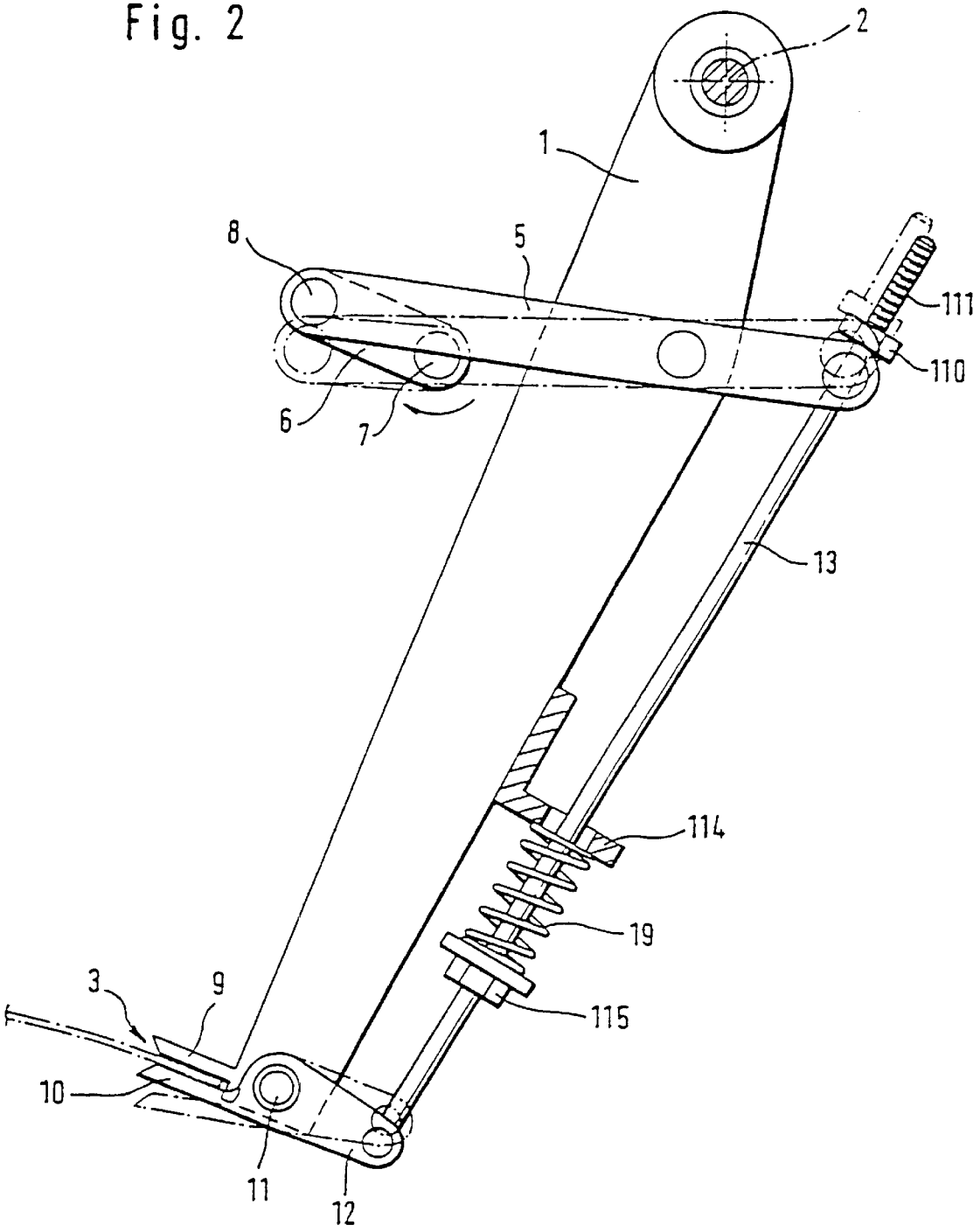
FIG. 2 illustrates a side view of a further embodiment, which is of particularly straightforward construction, of an apparatus of the type indicated here in an illustration similar to FIG. 1.
Figure 2A:
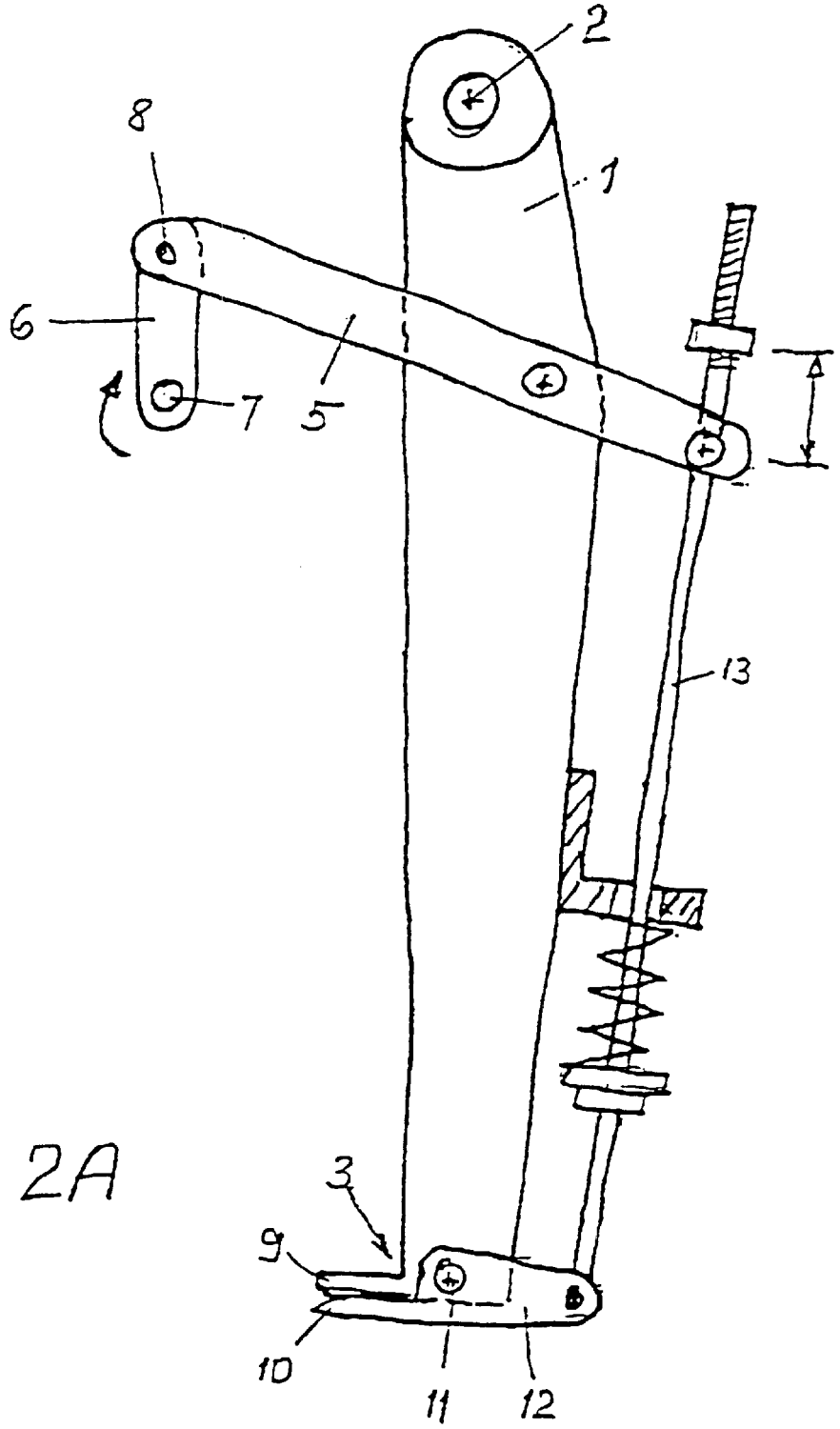
FIG. 2A illustrates a side view of the embodiment according to FIG. 2 in an operating position which differs from FIG. 2.
Figure 2B:
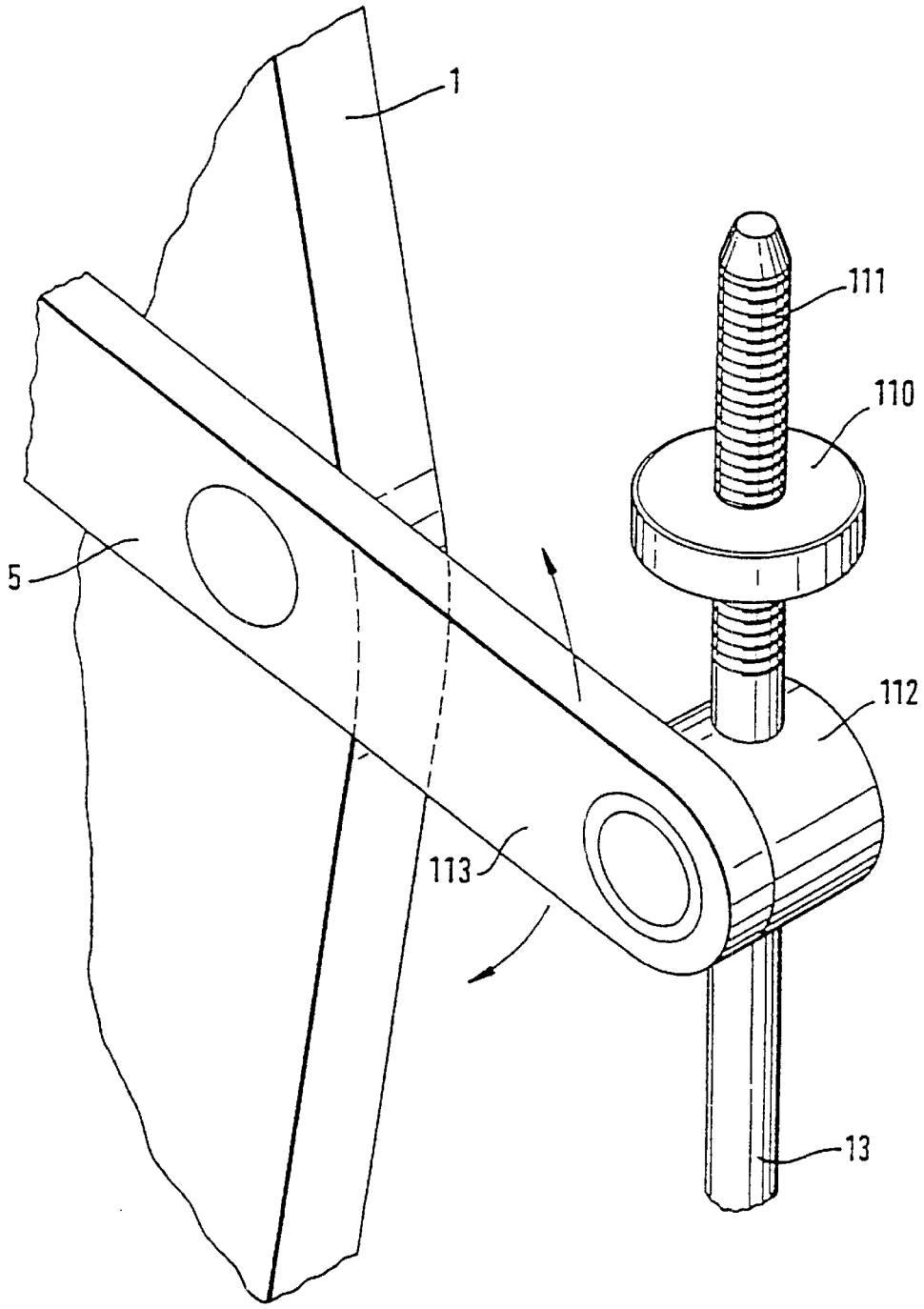
FIG. 2B illustrates a perspective view, in detail form, of the cam and of the cam follower of the actuating linkage of the embodiment according to FIGS. 2 and 2A, and FIGS. 3 and 4 illustrate side views of further-modified embodiments in an illustration similar to FIG. 1.

In the apparatus of the embodiment according to FIGS. 2, 2A and 2B, the gripper arm 1, which can be pivoted about the pivot axis 2, the gripper tongs 3, which are located at the bottom end of said gripper arm, the crankshaft 7, the crank 6 and the connecting rod connection to the gripper arm 1 are, for example, of the same or similar construction as in the case of the embodiment according to FIGS. 1 and 1A. However, the cam follower, which is designated 110 in the case of the embodiment in question here, rather than acting, via a lever, on the coupling rod 13 and from there on the rear projection 12 of the pivotable gripper claw 10, is seated directly on the coupling rod 13 as a stop which can be screwed in an adjustable manner along a threaded section 111 of the coupling rod 13. As can clearly be seen from FIG. 2B, said coupling rod is guided by way of a slide guide 112 which is connected to an extension 113 of the connecting rod 5 such that it can be rotated beyond the point of articulation of the latter on the gripper arm 1. The coupling rod 13 thus runs upwards from the bottom point of articulation on the rear projection 12 of the pivotable gripper claw 10, approximately along the gripper arm 1, through the slide guide 112 and, between its ends, is guided with play by way of a spring bearing 114 which projects from the gripper arm 1 and against which there is supported one end of a helical spring which forms the previously mentioned spring means 19 and of which the other end is positioned against a spring bearing 115 seated on the coupling rod 13. The helical spring 19, which wraps around the coupling rod 13, thus forces the gripper claw 10 into the closed position.

FIG. 2 shows the operating state of the apparatus immediately following the operation of a conveyable article being gripped in the receiving position of the gripper arm 1, i.e. immediately following closure of the gripper tongs 3 after the previously held open position, which is indicated schematically by chain-dotted lines. If, upon continuation of the rotation of the crankshaft 7 and pivoting of the crank 6, the gripper arm 1 then draws the conveyable article from left to right, in relation to the position shown in the drawing, the crank 6 pivoting in the clockwise direction, then the parts of the connecting rod 5 also move in the clockwise direction in this phase of the operating cycle and the cam-forming extension part 113 of the connecting rod 5 moves away from the stop 110, which forms the cam follower, and pushes the slide guide 112 downwards on the coupling rod 13 in the manner which can be seen from FIGS. 2A and 2B.

Following passage through the discharging position of the gripper arm, the pivoting directions of the parts of the connecting rod 5 reverse until finally, as the receiving position is approached, the cam-forming connecting-rod extension 113 has pushed the slide guide 112 into the vicinity of the stop 110 and the part 113 runs onto the stop 110, draws the coupling rod 13 upwards and opens the pivotable gripper claw 10.

It is also the case with the embodiment according to FIGS. 2, 2A and 2B that the opening of the gripper tongs 3 in the discharging position of the gripper arm 1 may be performed by a separate stop or cam, which is framework-mounted in an adjustable manner, in interaction with the actuating linkage.

It should be noted here that the basic idea which is being explained is not restricted to a certain direction of rotation of the crankshaft drive of the gripper arm, and that the coupling rod 13 may also be connected to the at least one pivotable gripper claw of the gripper tongs 3 such that actuation into the opening position takes place by pushing rather than by pulling. It should also be noted that it is not just an extension of the connecting rod 5 but also the connecting-rod section between the point of articulation on the gripper arm 1 and the articulation 8 in the direction of the crank 6 that can be used as a cam of the cam arrangement for moving the cam follower.

Figure 3:
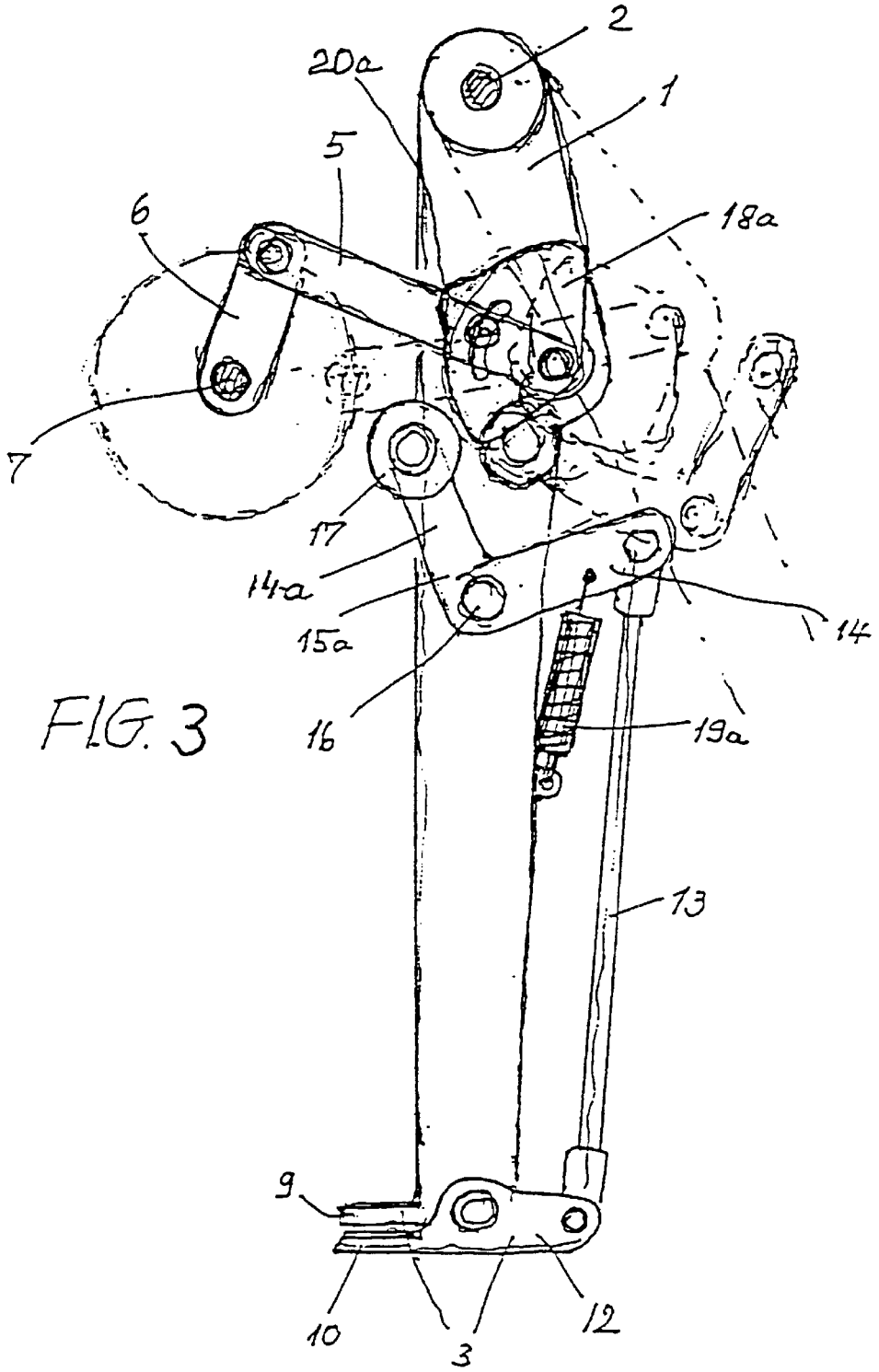

The embodiment according to FIG. 3, in which corresponding parts are also designated correspondingly to the embodiment according to FIG. 1, has an angle lever 15*a* which is connected in an articulated manner to the gripper arm 1 at 16 and to whose lever arm 14, which is oriented in the direction of the discharging position of the gripper arm 1, the coupling rod 13 is, once again, connected, said coupling rod leading downwards to the projection 12 of the gripper claw 10. The lever arm 14*a*, which is at an angle to the lever arm 14 and is directed towards the receiving position of the gripper arm 1, bears the follower roller 17, which in this case interacts with a cam plate 18*a* which is fastened on the connecting rod 5 such that it can be adjusted about the point of articulation of the connecting rod 5 in the manner which can be seen from FIG. 2. The drive crank 6 leads to the crank shaft 7 from its articulated connection 8 to the free end of the connecting rod 5.

Located on the circle-sector-form profile of the cam plate 18*a* is an opening cam 20*a* which comes into contact with the follower roller 17 both in the receiving position of the gripper arm 1 and in the discharging position of the gripper arm and in each case brings the gripper claw 10 into the open position in relation to the gripper claw 9, which is mounted in a fixed manner at the bottom gripper-arm end. As soon as the follower roller 17 has run beyond the opening cam 20*a* of the cam plate 18*a*, the spring means 19 draw the lever arm 14 downwards again and bring the gripper claw 10 back into the closed position of the gripper tongs, said closed position being shown in FIG. 2. The opening cam 20*a* may have different slopes on the rising side and on the falling side, in order to realize certain opening characteristics of the gripper claw 10 in coordination with the position of the gripper arm 1. It should be pointed out that the opening cam 20*a* of the cam plate 18*a* interacts with the follower roller 17 twice during each rotation of the crankshaft 7, that is to say for the gripper-claw opening in the receiving position and also in the discharging position. However, as has already been mentioned above, it may be expedient to control the opening of the gripper tongs 3 in the receiving position independently of the control of the opening of the gripper tongs 3 in the discharging position of the gripper arm 1, in order reliably to realize certain opening and closing characteristics of the gripper tongs in the receiving position of the gripper arm. From this point of view, embodiments according to FIGS. 1 to 2B are preferred to the previously described embodiment according to FIG. 3 and also to the embodiment according to FIG. 4, which will be described below.

It should also be noted, in relation to the opening and closing characteristics of the gripper tongs 3 of the embodiment according to FIGS. 1 and 1A, that as the gripper arm 1 approaches, by moving in the clockwise direction, the receiving position, the follower roller 17 is gradually forced downwards by the cam plate 18 and the gripper claw 10, which can be pivoted at the gripper-arm end, is opened in a corresponding gradual manner and remains open, this being based on a corresponding profiling of the opening cam 20 of the cam plate 18. When, as is shown in FIG. 1A, the cam plate 18 then continues to rotate in a clockwise direction, together with the drive crank 6, about the crankshaft 7, then the opening cam 20 is raised off very rapidly from the follower roller 17 although the gripper arm 1 only executes a minimal pivoting movement in this rotary region of the cam plate, this achieving the situation where the pivotable gripper claw 10, in the receiving position of the gripper arm 1, closes essentially momentarily before the gripper arm 1 begins to pivot towards the discharging position.

Figure 4:
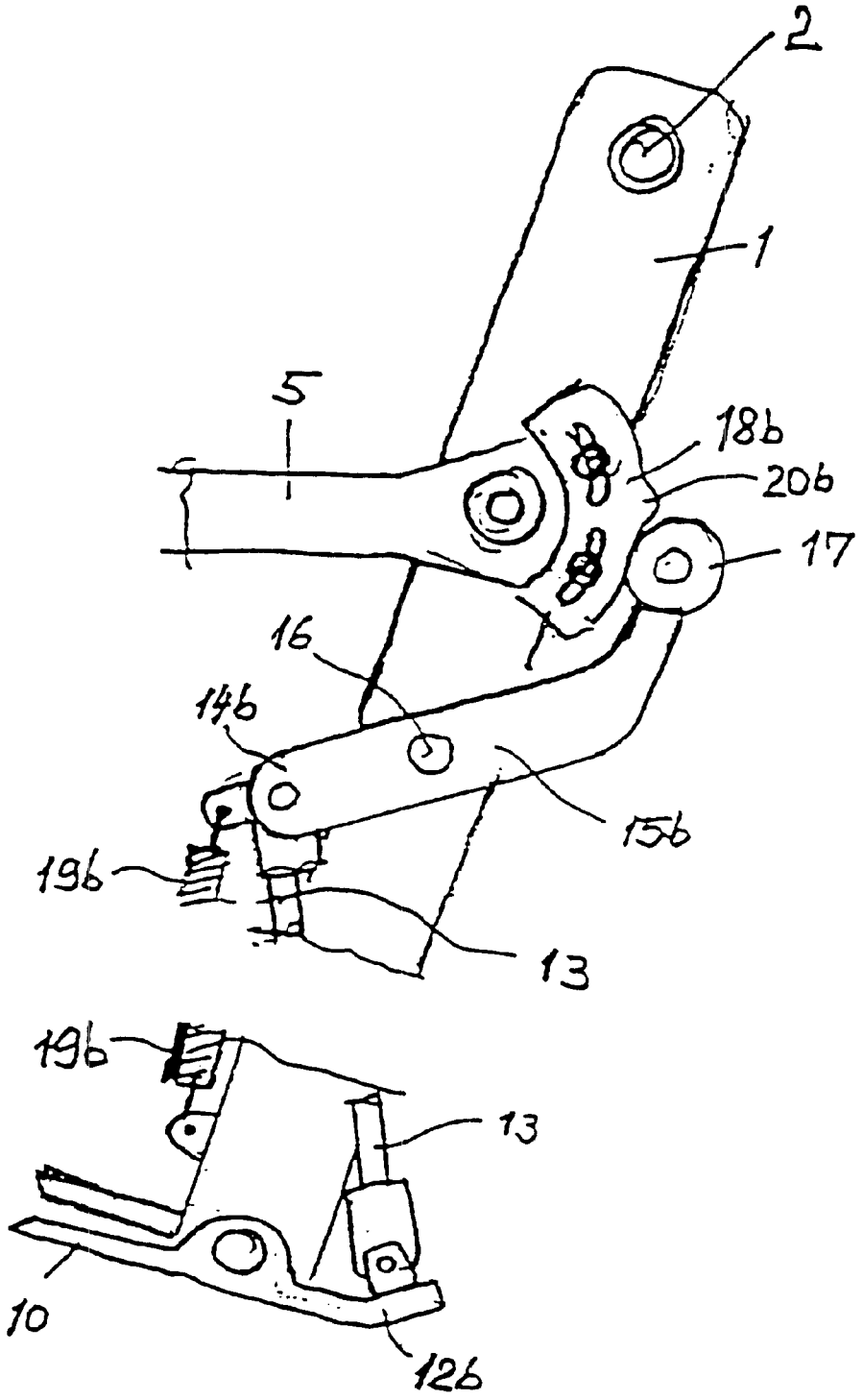

FIG. 4 shows a design corresponding to the embodiment according to FIG. 3, although the cam plate, designated 18*b* in this case, in the form of an annular-sector segment is fastened on the connecting rod 5, on a rear projection of the same, on the side which is directed towards the discharging position of the gripper arm 1 rather than on the side which is directed towards the receiving position of the gripper arm 1. The approximately annulus-sector-form cam plate 18*b* is provided with an opening cam 20*b* which, in the case of pivoting movements of the connecting rod 5 in the receiving position and/or the discharging position of the gripper arm 1, pivots the follower roller 17, at the right-hand end of the double-armed lever 15*b*, in the clockwise direction about the point of articulation 16 of the lever 15*b* on the gripper arm 1, with the result that the lever arm 14*b* draws the coupling rod 13 upwards and opens the gripper claw 10 counter to the force of the spring means 19*b*. The circumferential position of the opening cam 20*b* of the cam plate 18*b* in relation to the pivoting movements of the connecting rod 5 may be adjusted, similarly to the embodiment according to FIG. 3, by the cam plate being fastened adjustably on the connecting rod.

What is claimed is:

1. Apparatus for handling sheet-like conveyable articles having a gripper arm (1) which can be pivoted about a pivot axis (2) from a receiving position into a discharging position, the gripper arm having a free end, having a crankshaft (7) which is mounted parallel to the pivot axis and is coupled to a drive, having a connecting rod (5) which connects the crankshaft to the gripper arm, having gripping tongs (3) which are located at the free end of the gripper arm (1) and have a pair of gripper claws (9, 10), of which at least one (10) is connected pivotably to the free end of the gripper arm and is prestressed into the closed position by spring means (19, 19*a*, 19*b*), and having an actuating linkage (15, 13, 12) which has a cam follower (17) which is located on the gripper arm and interacts with a cam arrangement (18, 18*a*, 18*b*), for opening the at least one pivotable gripper claw (10) in the receiving position, wherein the cam arrangement contains a cam (18, 18*a*, 18*b*, 113) which is provided on the crankshaft (6, 7) or the connecting rod (5) and is intended for actuating the lever arm thereby opening the at least one pivotable gripper claw (10) at least in the receiving position.

2. Apparatus according to claim 1, wherein the actuating linkage contains a lever (15, 15*a*, 15*b*) which is mounted on the gripper arm (1) and to which one end of a coupling rod (13) is connected, of which the other end is connected to the pivotable gripper claw (10), wherein the cam follower (17) is connected to the lever.

3. Apparatus according to claim 2, wherein the lever arm comprises a first lever arm portion pivotably connected to a second lever arm portion wherein the coupling rod (13) is articulated on the first lever arm portion and the cam follower (17) is arranged on the second lever arm portion.

4. Apparatus according to claim 1, wherein the cam follower is in the form of a roller (17).

5. Apparatus according to claim 1, wherein the cam (18) is designed such that, via the cam follower (17), it opens the pivotable gripper claw (10) only in the receiving position.

6. Apparatus according to claim 1, wherein the cam (18; 18*a*; 18*b*) is designed such that, via the cam follower (17), it opens the pivotable gripper claw (10) both in the receiving position and in the discharging position.

7. Apparatus according to claim 1, wherein the cam (18, 18*a*, 18*b*), can be adjusted, in the plane determined by it, relative to the crankshaft (6, 7) and/or relative to the connecting rod (5).

8. Apparatus according to claim 1, wherein the cam (18, 18*a*, 18*b*) has at least one opening-cam region (20, 20*a*, 20*b*) which interacts with the cam follower or the follower roller (17) and has such a profiling that, in the receiving position, gradual opening is followed by rapid closure of the gripper claws.

9. Apparatus according to claim 1, wherein the actuating linkage (12, 13, 110) contains a coupling rod (13) which runs through a slide guide (112) of the connecting rod (5) from a point of articulation of the at least one pivotable gripper claw (10), extends approximately along the gripper arm (1) and is provided with a stop (110) which forms the cam follower and with which there interacts the cam (113), which is provided on the connecting rod (5) and is provided at one of the ends of the slide guide (112).

10. Apparatus according to claim 9, the cam (113) is formed by an extension of the connecting rod (5) beyond the point of articulation on the gripper arm (1), the slide guide (112) being provided at the end of said extension.

11. Apparatus according to claim 9, wherein the stop (110) can be adjusted along the coupling rod (13).

12. Apparatus according to claim 9, wherein the coupling rod (13) is provided with a spring bearing (115) and has a helical spring (19) wrapped around it, said helical spring forming the spring means for prestressing a gripper claw and being supported on an abutment (114) which is fastened on the gripper arm (1) and encloses the coupling rod (13) with play.

* * * * *